United States Patent [19]

Wilson

[11] Patent Number: 5,023,409

[45] Date of Patent: Jun. 11, 1991

[54] ELEVATOR CONTROL SAFETY DEVICE

[76] Inventor: Jim Wilson, 138 Bayou Cir., Gulfport, Miss. 39507

[21] Appl. No.: 388,392

[22] Filed: Aug. 2, 1989

[51] Int. Cl.[5] ..... B66B 5/02

[52] U.S. Cl. ..... 187/130; 187/140

[58] Field of Search ..... 157/1 R, 105, 140, 130; 40/468, 492; 116/64, 68; 174/5, 66, 67; 200/42.01, 304, 308, 333, 334; 340/480, 482, 484, 485, 296.12, 815.29; 439/131, 135, 136, 142

[56] References Cited

U.S. PATENT DOCUMENTS

| | | | |
|---|---|---|---|
| 1,801,228 | 4/1931 | Edhlund | 174/5 R |
| 1,807,344 | 5/1931 | Roth | 200/308 |
| 2,447,226 | 8/1948 | Bennett | 200/308 |
| 3,726,364 | 4/1973 | Citrin et al. | 187/105 |
| 3,863,214 | 1/1975 | Kerr, Jr. | 116/63 R X |

*Primary Examiner*—A. D. Pellinen
*Assistant Examiner*—W. E. Duncanson, Jr.
*Attorney, Agent, or Firm*—Banner, Birch McKie & Beckett

[57] ABSTRACT

A device for rendering elevator "call" buttons inaccessible during an emergency via a swinging or sliding panel or a rotating device which rotates the buttons from view. In all cases, safety instructions/information is displayed in place of the elevator "call" buttons.

12 Claims, 5 Drawing Sheets

ELEVATOR CONTROL SAFETY DEVICE

BACKGROUND OF THE INVENTION

The present invention generally relates to the field of elevator-control devices, and more particularly, is directed to a device which hastens the exit of persons from a building by reducing the time spent waiting for an elevator that is out of service during emergency situations.

During emergency situations such as fire, flood, earthquakes, tornados and the like, elevators become unsafe modes of transportation. Therefore, safety regulations usually require that elevators be shut down, and persons who would normally use them are required to use the stairs, instead, to exit to the outside. FIG. 1 illustrates a conventional instruction sign posted at each elevator.

When a building "emergency" alarm sounds, the stress level in each person naturally increases. As the emergency escalates, the ability for rational thought diminishes. Although clearly marked with signs warning against their use, people will instinctively attempt to make use of elevators in a fire or other emergency. Depending on the situation, the time waiting for an elevator that is out of service, or getting into an elevator &hat loses power during the emergency, could mean the difference between being trapped inside or safely exiting a building.

The prior art has addressed this matter to some extent. For example, U.S. Pat. No. 567,012 to Strong discloses a system for indicating on each floor of a building whether an elevator is in service. An indicator is provided on each floor, and all are connected to a vertically positioned rod which runs between floors. The rod is accessible from each floor and can be moved up or down to simultaneously change the status of the indicators on all floors. Each indicator has a stationary panel with the legend "This elevator is in service". A sliding panel with the legend "This elevator is out of service" is connected to the vertically running rod and can be positioned over the stationary panel in accordance with the up and down movement of the rod.

U.S. Pat. No. 446, 907 to Whitlock also discloses a system for indicating on each floor whether an elevator is in service. Like the Strong system, Whitlock has an indicator on each floor which is connected to a common control device. Rather than a rod as used by Strong, Whitlock uses an endless wire and a series of pulleys. A "hand-hold" is attached to the wire on each floor and is used to move the wire up and down in order to change the status of the indicators.

U.S. Pat. No. 2,998,500 to Di Carlo discloses a cover for the floor selection buttons in an elevator. The cover is used to prevent selection of certain floors. Holes are formed in the cover which match up with buttons for floors which can be selected. The remaining buttons are thus covered by the plate and cannot be used.

In the existing state of confusion during a building emergency, with the capacity for rational thought being lost, when one does realize that the elevator is either dangerous or out of service due to the emergency at hand, the person will need clear and concise safety instructions on how to safely and quickly exit the building. The above-mentioned prior art systems and devices do not sufficiently meet such a situation. Thus, there is a need in the art for an improved system.

SUMMARY OF THE INVENTION

Accordingly, it is the overall object of the present invention to overcome the above-mentioned deficiencies and shortcomings associated with building-emergency warning systems known in the prior art.

It is a specific object of the present invention to provide an elevator-control safety device which prevents an elevator from being called during a building emergency and also prevents a potential user from falsely thinking that the elevator is still in service.

It is another specific object of the present invention to provide an elevator-control safety device which effectively provides safety instructions to potential users of an elevator during a building emergency.

It is a further specific object of the present invention to provide an elevator-control safety device which may readily be installed in existing elevator systems.

It is a still further specific object of the present invention to provide an effective elevator-control safety device which is low in cost and easy to implement.

These, and other objects of the present invention, are achieved by automatically covering the elevator "call" buttons in the event of a building emergency. During a fire, or other emergency, people will, as mentioned above, attempt to call the elevator via the "call" buttons and wait for the elevator to arrive, even though the elevator might have already been disabled due to the emerqency at hand. The present invention is directed to a shield in the form of a plate which swings down over the "call" buttons, making it obvious that the elevator is out of service. In addition to the plate, there is provided a set of safety instructions ranging from "out of service", or "use stairs" to emergency information and phone numbers with a map to the nearest exit. The combination of a shield, that visually alerts a person that the elevators are out of use, and safety instructions, exposed when the shield covers the elevator "call" buttons, allow much faster evacuation of a building than other systems known in the prior art.

To evacuate a building quickly, the persons inside must be alerted at the earliest possible time to the emergency. One of the most common ways is by setting off the building fire alarm. Because most people would not know where the fire alarm is as soon as an emergency situation has developed, the present invention also lends itself easily to conversion to a manually operated fire alarm. This would give a central, and obvious, location for a fire-alarm switch if anyone should need one.

DETAILED DESCRIPTION

Figure 1:
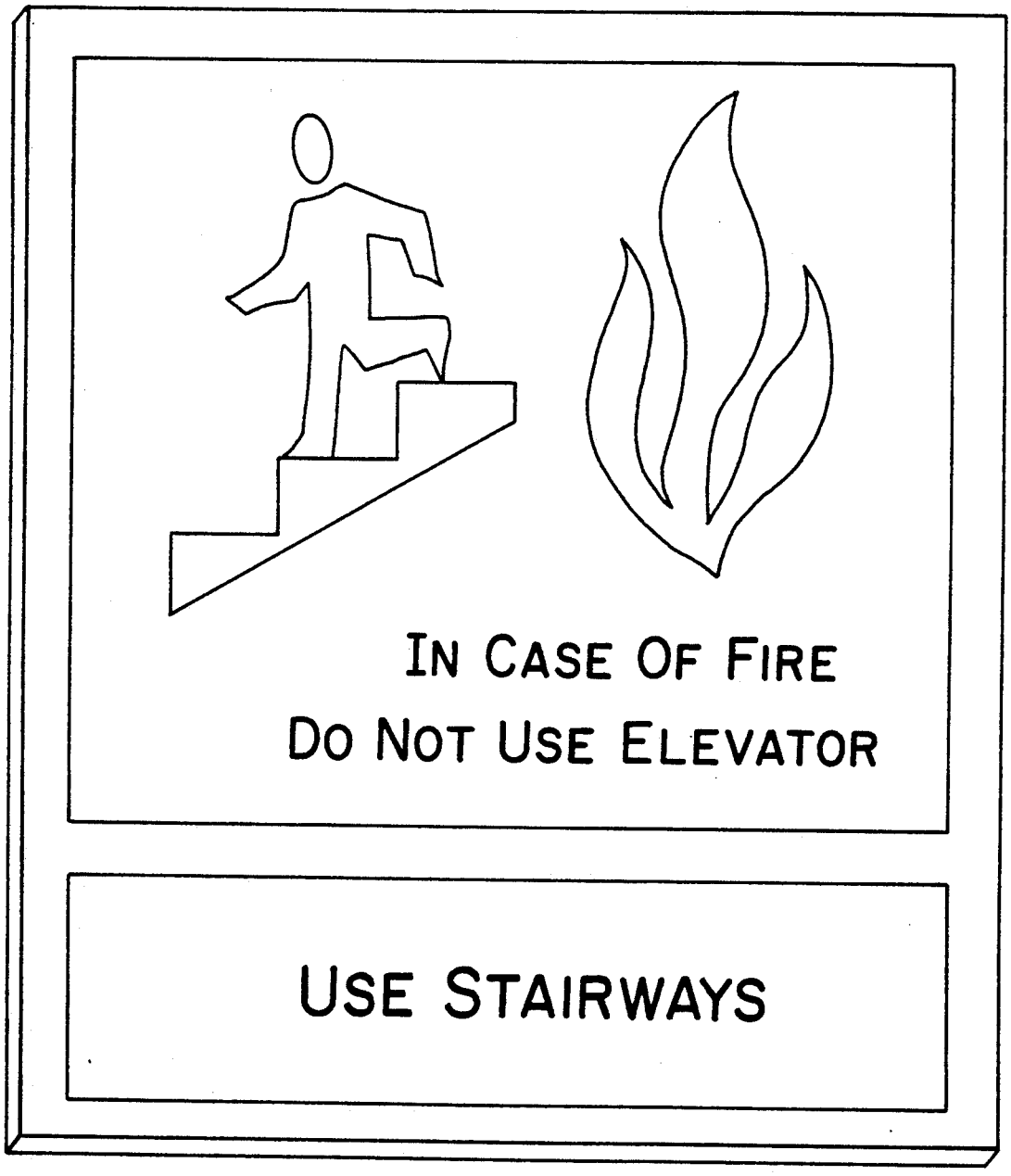
FIG. 1 PRIOR ART
FIG. 1 is a front view of a conventional fire-emergency sign.
Figure 2:
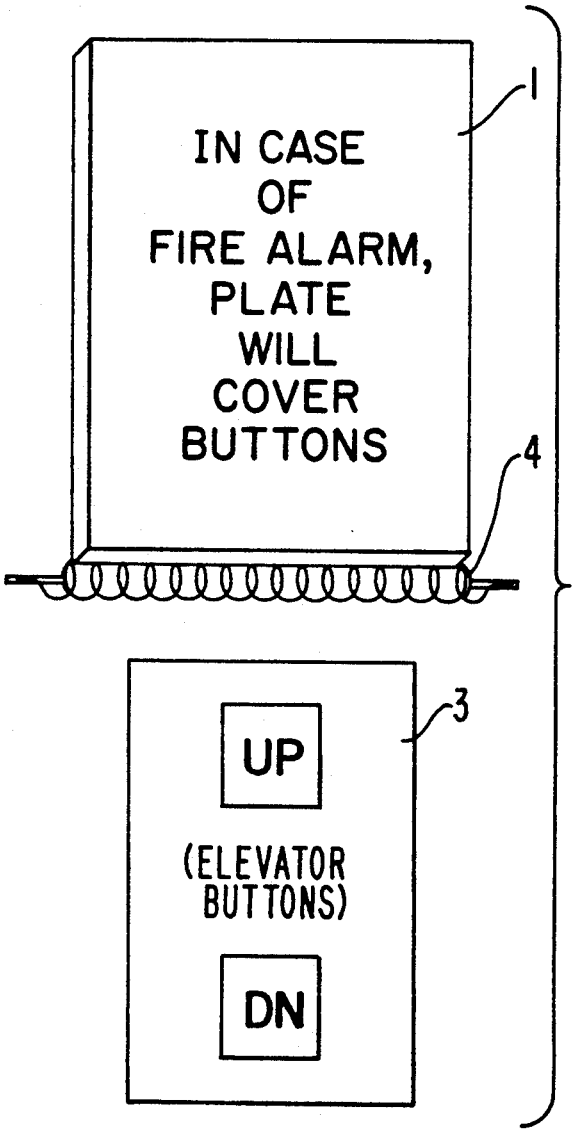
FIGS. 2, 4, 6 and 8 are front views of an elevator safety-cover plate in accordance with the present invention.
Figure 3:
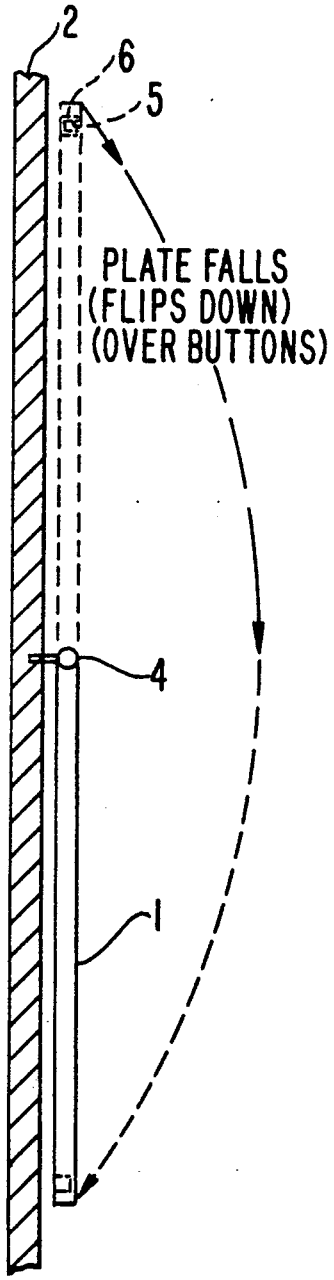
FIGS. 3, 5, 7 and 9 are side views of an elevator safety-cover plate in accordance with the present invention.

FIGS. 2 and 3 are simplified illustrations of the cover-plate assembly in accordance with the present invention. The assembly includes a plate which is positioned immediately above elevator "call" buttons 3 and is attached to wall 2 by hinge 4. Plate 1 is held adjacent to wall 2 by latching mechanism 5 with pressure spring 6 therebetween. In the event of a building emergency, latching mechanism 5 releases plate 1, which is pushed away from wall 2 by spring 6. Plate 1 rotates about hinge 4 and covers "call" buttons 3 as shown in FIG. 3.

Figure 4:
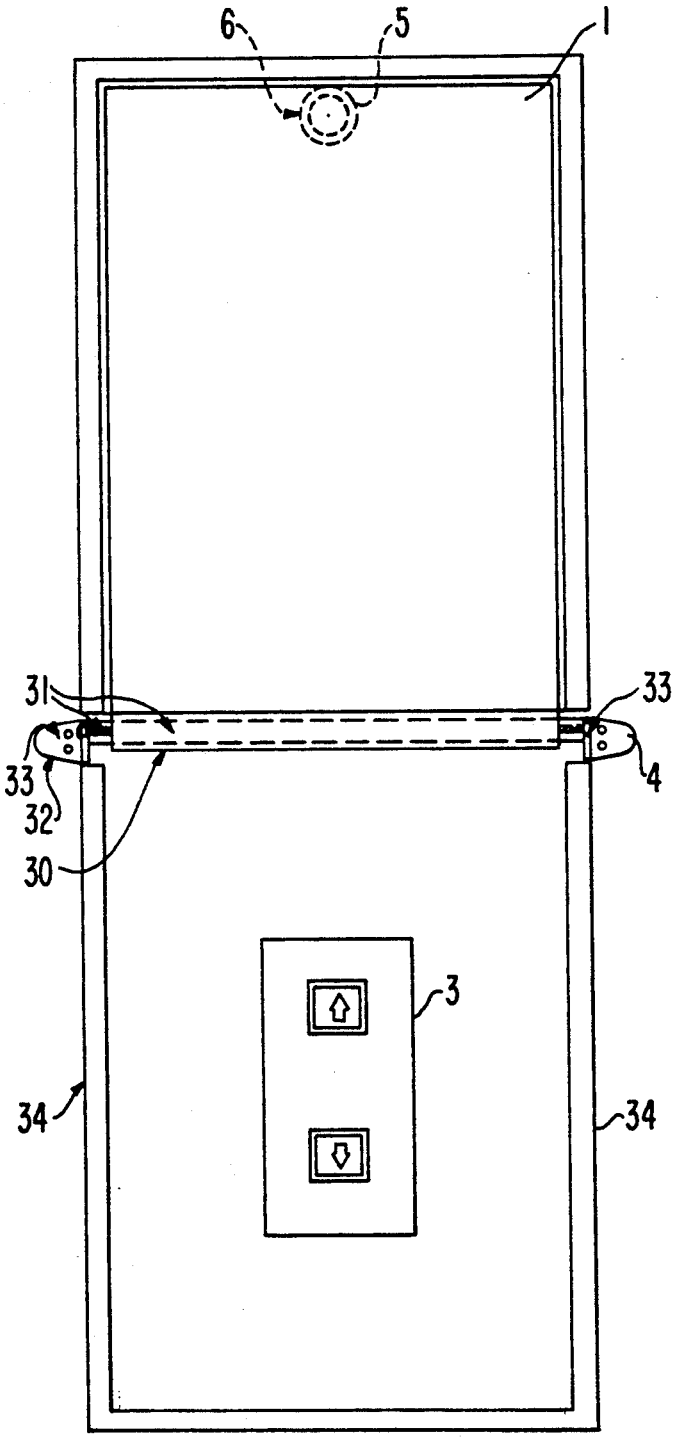
Figure 5:
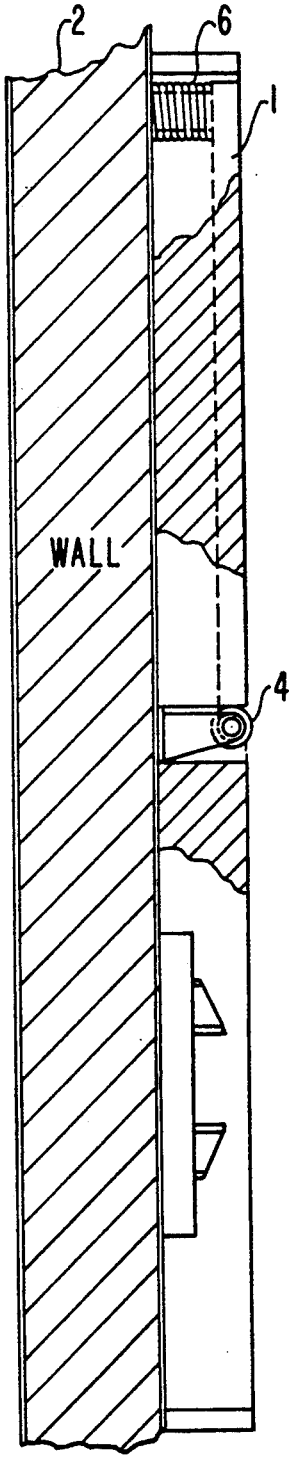

FIGS. 4 and 5 illustrate the construction of the cover-plate assembly in greater detail with the reference numbers corresponding to those in FIGS. 2 and 3. Plate 1 may be formed of any metal which is economical and easy to fabricate. The physical size of plate 1 need only be large enough to cover "call" buttons 3 and large enough to accommodate a message with letters (or words) of proper size. Plate 1 may also be formed of other materials such as plastic or wood.

As shown in FIG. 4, hinge 4 is formed of a number of component parts including a hinge sleeve 30 attached to plate 1, a hinge bar 31 passing through hinge sleeve 30 and a mounting bracket 32 attached to hinge bar 31 by lock pins 33 for attaching the hinge to wall 2.

As shown in FIG. 4, the cover-plate assembly also includes a plate-housing 34 which is not necessary to the operation of the cover-plate assembly.

Figure 6:
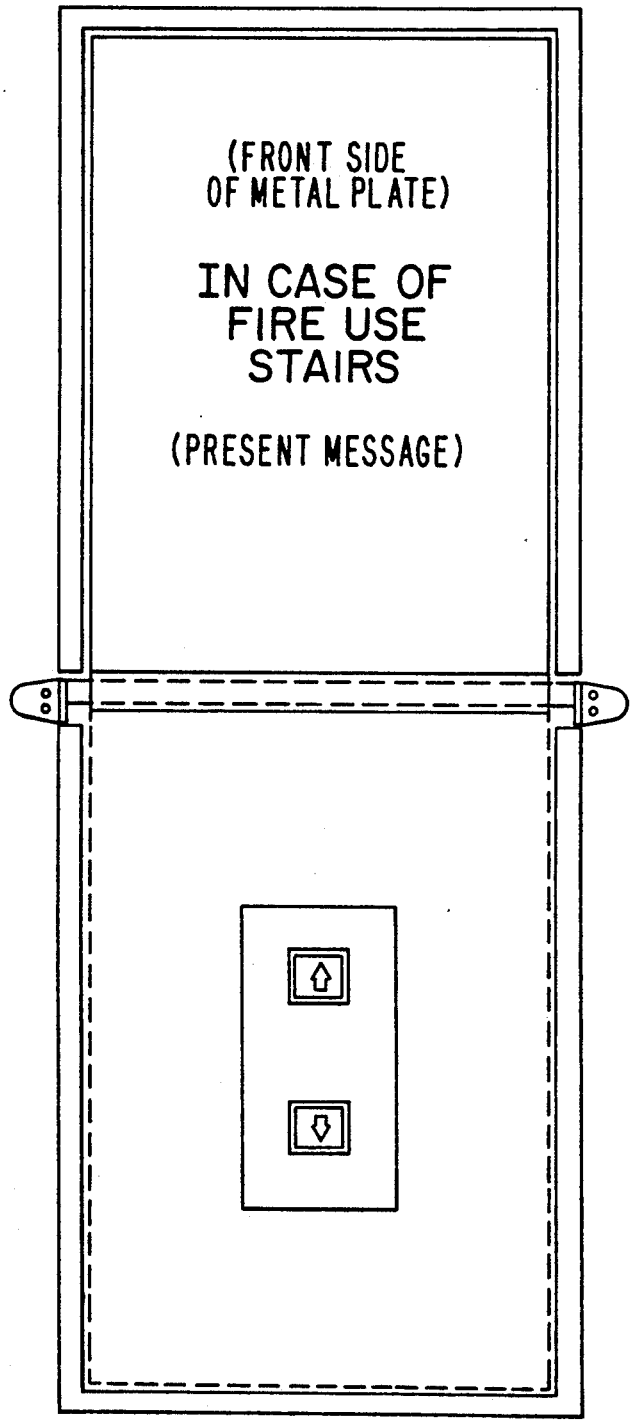
Figure 7:
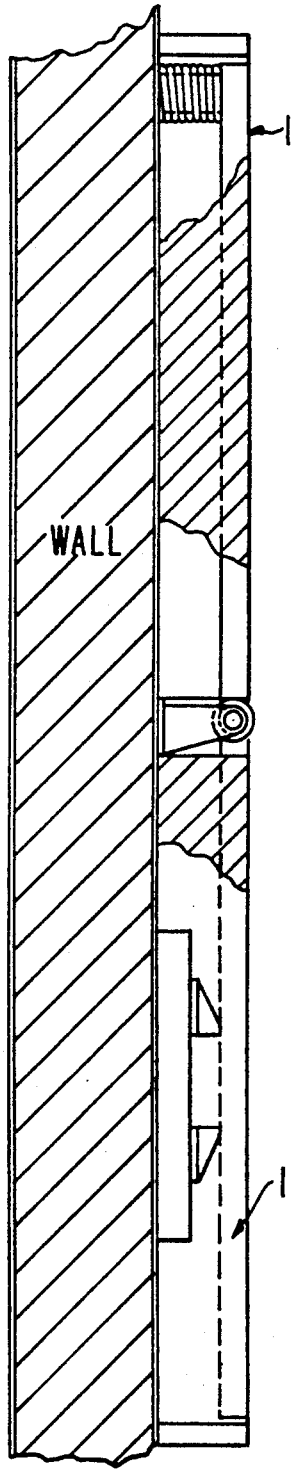

FIGS. 6 and 7 further illustrate the cover-plate assembly in the upright, or latched, position above the elevator "call" buttons. As shown in FIG. 6, plate 1 displays the legend "IN CASE OF FIRE USE STAIRS."

Figure 8:
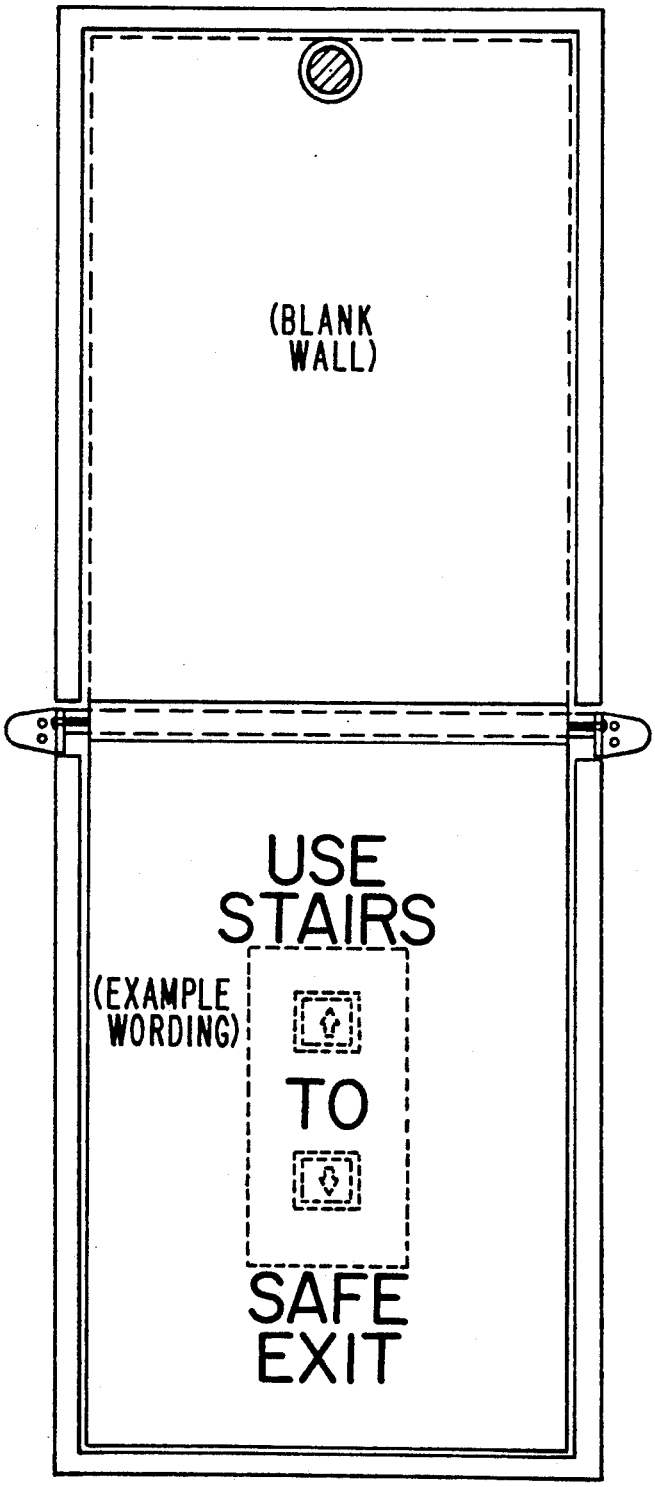
Figure 9:
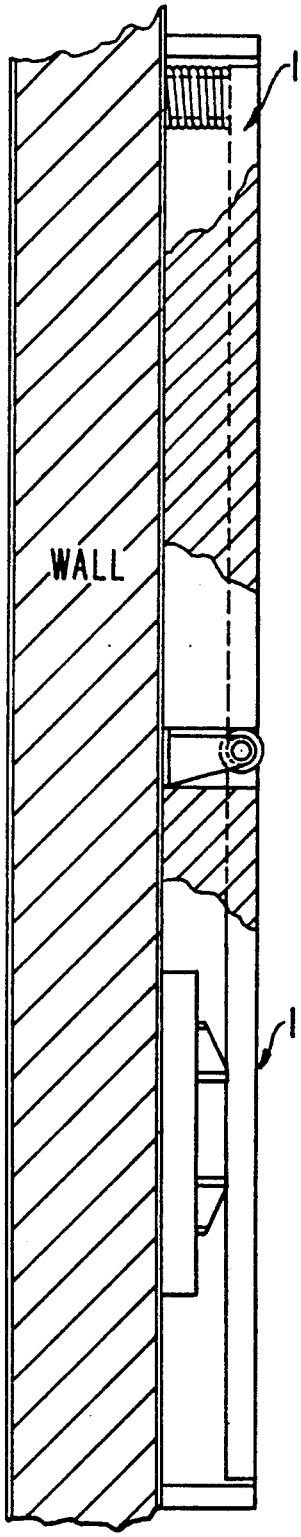

FIGS. 8 and 9 illustrate the cover-plate assembly in the down, or unlatched, position covering the elevator "call" buttons. Plate 1 displays the legend "USE STAIRS TO SAFE EXIT."

Latching mechanism 5 may be formed of an electromagnet and a mating element attached to plate 1. Pressure spring 6 may also be formed as a part of latching mechanism 5.

The circuit that the latching mechanism draws its current from is connected directly into the fire-alarm system. When the fire alarm is activated, the power supplied to the electromagnet to keep plate 1 suspended above the "call" buttons is turned off. When the electromagnet loses power, spring 6 pushes plate 1 away from the wall, whereas plate 1 flips down and covers elevator "call" buttons 3. Spring 1 is strong enough to overcome the inertia of plate 1, to push it away from wall 2, but is not strong enough to overcome the force of the electromagnet that holds plate 1 upright against the wall. An alternative to using a pressure spring would be to position plate 1 far enough away from wall 2 in the latched position that the latching mechanism is responsible for holding plate 1 in the upright position. When released, plate 1 would fall due to gravity.

An alternate embodiment of the above-mentioned invention is a plate propelled by a spring-loaded latch that slides on a set of horizontally or vertically aligned tracks into place in front of the elevator "call" buttons.

A further embodiment of the above invention includes placing the "call" buttons on a device that rotates into wall 2. When the rotating device (for example, a cylinder) rotates, the safety information as stated above is rotated out into view as the elevator "call" buttons are rotated back into the wall.

Another embodiment of the present invention involves use of the device for signaling a fire or other emergency condition. A handle is provided near the top of each plate to allow the plate to be manually pulled down to set off the alarm. Each elevator fire-safety device, equipped as a fire alarm, would also include a conductive piece of metal on the backside of the plate when it is upright and not covering the buttons. The metal strip is electrically connected to the fire-alarm control, such that when the electrical circuit is broken, the fire alarm is sounded and the rest of the elevator "call-button" plates will fall due to the power being cut off from each of their own respective electromagnets.

It is understood that one skilled in the art can make modifications and changes in the arrangements and elements of the presented embodiments without departing from the spirit and scope of the invention.

I claim:

1. A safety device for indicating the service status of a building elevator having elevator call buttons, said device comprising:

a shield mounted adjacent said call buttons and adapted for movement from a first position to a second position, said shield rendering said call buttons inaccessible to elevator users when said shield is in said second position;

releasing means for holding said shield in said first position and releasing said shield for movement from said first position to said second position upon being activated; and control means for activating said releasing means in response to a building emergency.

2. The safety device of claim 1, wherein said building emergency is indicated by a fire alarm and said control means responds to a fire alarm signal for activating said releasing means.

3. The safety device of claim 1, wherein said shield carries safety information displayable to elevator users when said shield is in said second position.

4. The safety device of claim 1, wherein said releasing means comprises a latching mechanism having an electromagnet, said electromagnet being energized by an electric current flow for holding said shield in said first position when no building emergency exists and being de-energized by an interruption in said electric current flow for releasing said shield for movement to said second position when a building emergency exists.

5. The safety device of claim 4 wherein said safety device further includes spring means for urging said shield to said second position when released by said releasing means.

6. The safety device of claim 1 further including manually operated signalling means for signalling a building emergency.

7. A safety device for indicating the service status of a building elevator having elevator call buttons, said device comprising:

movable mounting means for mounting said elevator call buttons, said mounting means being adapted for movement from a first position to a second position, said call buttons being inaccessible to elevator users when said moveable mounting means is in said second position; and control means for activating said moveable mounting means in response to a building emergency.

8. The safety device of claim 7, wherein said moveable mounting means carries safety information displayable to elevator users when said moveable mounting means is in said second position.

9. The safety device of claim 7, wherein said building emergency is indicated by a fire alarm and said control means responds to a fire alarm signal for activating said moveable mounting means.

10. The safety device of claim 7, wherein said moveable mounting means comprises a latching mechanism having an electromagnet, said electromagnet being energized by an electric current flow for holding said moveable mounting means in said first position when no building emergency exists and being de-energized by an interruption in said electric current flow to allow movement of said moveable mounting means to said second position when a building emergency exists.

11. The safety device of claim 10 wherein said moveable mounting means further includes spring means for urging said moveable mounting means to said second position when activated by said control means.

12. The safety device of claim 7 further including manually operated signalling means for signalling a building emergency.

* * * * *